United States Patent [19]

Pope et al.

[11] Patent Number: 4,487,711

[45] Date of Patent: Dec. 11, 1984

[54] CINDER AGGREGATE FROM PUREX WASTE

[75] Inventors: James M. Pope, Orchard Park, N.Y.; Don E. Harrison, Murrysville; Edward J. Lahoda, Edgewood, both of Pa.

[73] Assignee: Westinghouse Electric Corp., Pittsburgh, Pa.

[21] Appl. No.: 393,270

[22] Filed: Jun. 29, 1982

[51] Int. Cl.[3] ..... G21F 9/16

[52] U.S. Cl. ..... 252/629; 252/628; 252/631

[58] Field of Search ..... 252/628, 629, 631

[56] References Cited

U.S. PATENT DOCUMENTS

| | | | |
|---|---|---|---|
| 4,020,004 | 4/1977 | Schulz et al. | 252/631 |
| 4,202,792 | 5/1980 | Kaufmann et al. | 252/301.1 W |
| 4,224,177 | 9/1980 | Macedo et al. | 252/301.1 W |
| 4,234,449 | 11/1980 | Wolson et al. | 252/301.1 W |
| 4,253,985 | 3/1981 | Filter et al. | 252/631 |
| 4,374,762 | 2/1983 | Olinger et al. | 252/631 |
| 4,376,070 | 3/1983 | Pope et al. | 252/629 |
| 4,377,507 | 3/1983 | Pope et al. | 252/629 |

FOREIGN PATENT DOCUMENTS

| | | | |
|---|---|---|---|
| 42770 | 12/1981 | European Pat. Off. | 252/629 |
| 44149 | 1/1982 | European Pat. Off. | 252/629 |
| 46085 | 2/1982 | European Pat. Off. | 252/629 |
| 2611689 | 9/1977 | Fed. Rep. of Germany | 252/629 |

OTHER PUBLICATIONS

Pope, et al. 1980, Advanced Method For Making Vitreous Waste Forms, Scientific Basis For Nuclear Waste Management, vol. 3, pp. 93–100.

*Primary Examiner*—Deborah L. Kyle
*Assistant Examiner*—Howard J. Locker
*Attorney, Agent, or Firm*—R. D. Fuerle

[57] ABSTRACT

Disclosed is a process for making a cinder aggregate from neutralized PUREX waste. The PUREX waste is concentrated to about 30 to about 40 percent solids and a colloid of such de-alcoholated alkoxides of silicon, boron, and aluminum are added to the PUREX waste as are necessary to produce a mixture containing about 0.0001 to about 1 percent aluminum hydroxide, about 5 to about 15 percent silica, and about 1 to about 3 percent boric oxide. The resulting mixture is heated to about 400 to about 700° C. which produces a cinder. The cinder will be transported to a vitrification center where it can be disintegrated in ammonium hydroxide and the nuclear waste can be permanently encapsulated in glass.

8 Claims, 1 Drawing Figure

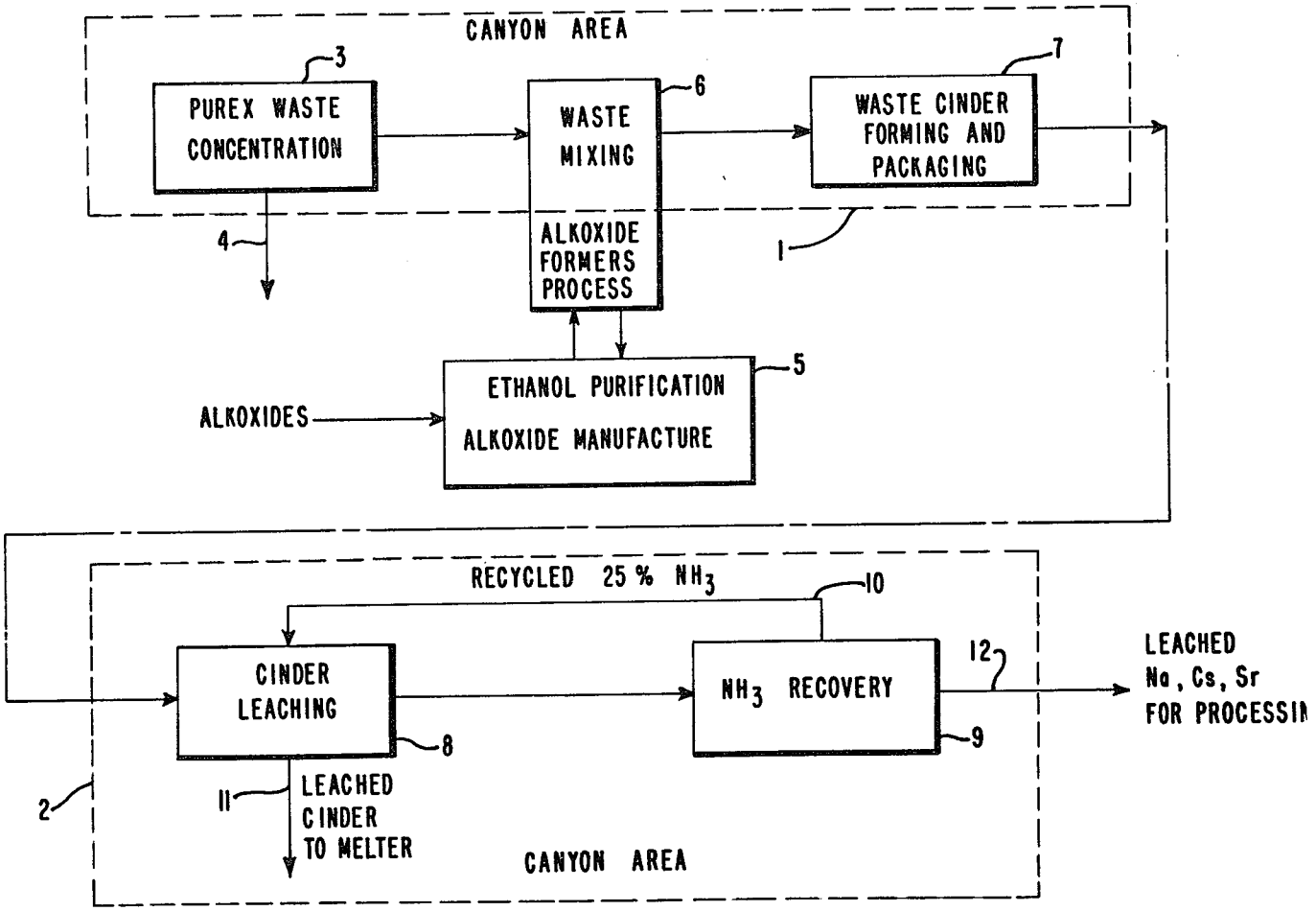
CANYON AREA
PUREX WASTE CONCENTRATION
3
4
WASTE MIXING
6
ALKOXIDE FORMERS PROCESS
WASTE CINDER FORMING AND PACKAGING
7
1
ETHANOL PURIFICATION
ALKOXIDE MANUFACTURE
5
ALKOXIDES
RECYCLED 25 % $NH_3$
10
$NH_3$ RECOVERY
9
12
LEACHED Na, Cs, Sr FOR PROCESSIN
CINDER LEACHING
8
LEACHED CINDER TO MELTER
11
CANYON AREA
2

CINDER AGGREGATE FROM PUREX WASTE

BACKGROUND OF THE INVENTION

In the PUREX process ("PUREX" is an acronym for "plutonium-uranium recovery by extraction"), waste reprocessing facilities dissolve used fuel from nuclear reactors in nitric acid. The uranium and plutonium are extracted with an organic solvent and the remaining aqueous phase is frequently neutralized with sodium hydroxide to permit storage in carbon steel tanks.

Because this PUREX waste is radioactive, yet has no commercial utility, it must be safely disposed of such as by immobilization in glass at a vitrification facility. The quantity of PUREX waste at some waste reprocessing facilities is too small to justify the cost of constructing a vitrification plant at the reprocessing facility, which means that the PUREX waste must be transported to a central vitrification facility. However, because the PUREX waste is a radioactive liquid it cannot be transported due to the danger of spillage in route. Evaporation of the water in the PUREX waste would produce a fine powder which also cannot be transported because of the danger that any container in which the powder is placed may break open, permitting the wind to disperse the powder. Thus, the waste can only be transported in the form of a solid having a particle size large enough to prevent air dispersion.

SUMMARY OF THE INVENTION

We have discovered that a cinder aggregate can be made from PUREX waste by adding de-alcoholated alkoxides to it and heating the resulting mixture. The cinder can be safely transported as it is not air dispersable. Once the cinder is at the vitrification facility it can be easily disintegrated in ammonium hydroxide. After the ammonia has been removed with heat, the resulting slurry is entirely compatible with present vitrification processes.

The process of this invention is relatively simple and requires the addition of only de-alcoholated alkoxides to the waste. It eliminates the need for high temperatures which require expensive furnaces, high energy costs, and which may volatilize radioactive components of the waste.

PRIOR ART

U.S. Pat. No. 4,020,004 discloses a conversion of radioactive ferrocyanide compounds to immobile glass by fusion together with sodium carbonate and a mixture of basalt and boron trioxide, or silica and lime.

U.S. Pat. No. 4,202,792 discloses mixing liquid nuclear waste with glass formers to obtain a borosilicate glass compound.

U.S. Pat. No. 4,224,177 discloses leaching a glass rod containing nuclear waste in a 3N hydrochloric acid solution and 15 to 20 percent aqueous ammonium chloride solution.

U.S. Pat. No. 4,234,449 discloses mixing a radioactive alkali metal with particulate silica in order to make a glass for storing the radioactive material.

U.S. patent application Ser. No. 272,852 filed June 12, 1981 by J. M. Pope et al. entitled, "Alcohol Free Alkoxide Process for Containing Nuclear Waste," discloses the containment of nuclear waste in an alcohol-free mixture of alkoxides which are converted to a glass.

DESCRIPTION OF THE INVENTION

The accompanying drawing is a block diagram illustrating a certain presently preferred embodiment of the process of this invention.

In the drawing there are two canyon areas 1 and 2 indicated by the dotted lines; the blocks within the canyon areas indicated that those processes are conducted under radioactive containment procedures. In the first step of this invention, the PUREX waste is concentrated in block 3 as, for example, by evaporation, producing a clean water discharge 4. In a separate step, alkoxides are mixed in block 5 and heated to remove the alcohol which is already present as well as the alcohol which is formed in the reaction. The mixed and de-alcoholated alkoxides are mixed with the concentrated PUREX waste in block 6 and that mixture is then sent to block 7 where the water is evaporated and the cinder is formed by heating. The packaged cinders are then shipped to a vitrification center and eventually enter block 8 where they are decomposed and leached with ammonium hydroxide. The resulting slurry is heated to recover the ammonia in block 9 which is recycled in line 10. The remaining slurry is sent to the vitrification facility in line 11.

The starting material for the process of this invention is neutralized PUREX waste which is produced in a nuclear fuel reprocessing facility. In the PUREX process spent nuclear fuel is dissolved in nitric acid and the uranium and plutonium is extracted with an organic solvent. The remaining aqueous phase is neutralized with sodium hydroxide which produces a waste product containing about 20 to about 30 percent total solids of which at least about 15 percent is sodium, the remainder being nitrate, hydroxide, radionuclides, iron oxide, and other compounds. In the first step of this invention, the neutralized PUREX waste is concentrated to about 30 to about 40 percent solids. Concentration of the waste makes it easier to work with as less fluid must be handled. However, if the concentration is greater than 40 percent it becomes difficult to pump. Concentration can be accomplished by heating to evaporate the water.

In a separate step, it is necessary to prepare the solidification material. The solidification material is prepared by mixing such alkoxides of silicon, boron, and aluminum as are necessary, with alcohol then water, followed by distillation of the alcohol. These alkoxides have the general formula $Si(OR)_4$, $B(OR)_3$, and $Al(OR')_3$ where R is alkyl to $C_{10}$ and R' is hydrogen or R. The R group is preferably methyl as it is the least expensive and it does not produce a water-alcohol azeotrope as some of the higher R groups do. The R' group is preferably hydrogen as that is less expensive. It is preferred that all the R groups be the same for simplicity of operation. For the same reason it is also preferred that the alcohol used in this mixture be the same alcohol that is condensed out of the alkoxides. The production of the solidification material from alkoxides is a known process which is fully described in U.S. patent application Ser. No. 27,852 filed June 12, 1981 by J. M. Pope et al. entitled, "Alcohol Free Alkoxide Process for Containing Nuclear Waste," herein incorporated by reference. Briefly, the preparation involves the initial addition of the alcohol to the alkoxide in a mole ratio of alcohol to alkoxide of about 0.5 to about 3, followed by water in a mole ratio of water to alkoxide of about 3 to about 6, though it is also possible to prepare the solidification material using variations of this process. The mixture of the alkoxides produces a colloid.

In the next step of this invention, the alcohol is evaporated from the colloid. This is accomplished by simply heating to the boiling point of the alcohol until evolution of the alcohol ceases. The alcohol that is volatilized is both the alcohol that is initially added and the alcohol that is condensed out when the alkoxide polymerizes as indicated in the following general equation where M is a metal such as silicon, boron, or aluminum:

$$M(OR)_n + H_2O \rightarrow M(OH)_n + nROH \uparrow$$

In the next step of this invention, the colloid is mixed with the concentrated PUREX waste. Because the waste may already contain some aluminum, boron, or silicon, the quantity of aluminum, boron, or silicon alkoxide in the solidification material must be adjusted to take into account the amount of these elements which are already present in the waste. Thus, the composition of the solidification material should be adjusted so that the resulting mixture of the concentrated PUREX waste and the prepared solidification material has a composition of about 0.001 to about 1 percent (all percentages herein are by weight) aluminum hydroxide ($Al(OH)_3$), about 5 to about 15 percent silica ($SiO_2$), and about 1 to about 3 percent boric oxide ($B_2O_3$), the remainder being water and the other elements and compounds which were in the concentrated PUREX waste.

We have found that if less aluminum hydroxide is present, the resulting cinder will not stick together and form a coherent solid and if more aluminum hydroxide is present the resulting cinder will be so glassy that it will be difficult to leach and disintegrate it. If less silica is present, a powder also results and if more is present it is difficult to leach the cinder. The boric oxide has the reverse effect, so that if less is present the cinder cannot be leached easily and if more is present a powder is produced. For these reasons, the preferred concentration of aluminum hydroxide is about 0.001 to about 0.002 percent, the preferred concentration of silica is about 5 to about 10 percent, and the preferred concentration of boric oxide is about 1.5 to about 2.5 percent.

In the next step of the process of this invention, the mixture of concentrated PUREX waste and prepared solidification material is heated to about 400° to about 700° C. which evaporates all the water present and reduces the solids to a cinder. Heating to a lower temperature tends to produce a powdery material and heating to a higher temperature tends to produce a cinder which is not leachable or readily disintegratable. For this reason, the preferred temperature range is about 550° to about 650° C.

Once the cinders have been produced they can be safely packaged and transported by rail, truck, or other means to a vitrification center where they are processed for permanent containment in glass. At the vitrification center, ammonium hydroxide is added to the cinders which disintegrates their structure, producing a powder, and leaches out the sodium and boron. Ammonium hydroxide is used because the ammonia is recoverable and reusable and it does not add to the quantity of the volume of the waste. The ammonium hydroxide is produced by adding ammonia to water; it typically has a concentration of about 10 to about 29 percent ammonia because less than 10 percent requires too long of a leaching time and 29 percent is the saturation level of ammonia in water. After the ammonia leaching has been completed, the slurry is heated to volatilize the ammonia, which is recovered and recycled. The sodium is then removed from the slurry by conventional, known processes and the slurry then enters the glass vitrification process without further modification. The glass vitrification process is a known procedure, fully described in the literature.

The following example further illustrates this invention.

EXAMPLE

A 1866 gram mixture was prepared of 30 percent silicon tetraethoxide, 8.5 percent percent boron triethoxide and 61.5 percent percent alcohol. To this mixture was added 2614 grams of water. The mixture was then heated to 148° F. until all of the alcohol had volatilized.

A simulated PUREX waste was prepared having the following composition (in percent):

| | | | | | |
|---|---|---|---|---|---|
| $Na_2SO_4.10H_2O$ | 15.8 | $Al(OH)_3$ | 0.007 | Fission Products | |
| $NaNO_3$ | 40.6 | $AlF_3$ | 0.1 | SrO | 0.002 |
| $NaNO_2$ | 32.9 | $Na_3PO_4$—$12MoO_3$ | 0.8 | $RuO_2$ | 0.003 |
| NaOH | 1.2 | $MnO_2$ | 0.2 | $Ba(OH)_2.8H_2O$ | 0.1 |
| NaCl | 0.004 | $Na_2U_2O_7$ | 1.0 | Ca(OH) | 0.006 |
| $Fe(OH)_3$ | 3.8 | | | $ZrO_2$ | 0.002 |
| $FePO_4$ | 2.3 | Rare Earths | | | |
| $Cr(OH)_3$ | 0.5 | $Eu_2O_3$ | 0.1 | | |
| $Ni(OH)_2$ | 0.2 | $CeO_2$ | 0.006 | | |

578 grams of the simulated waste was heated to 212° F. to drive off water and concentrate the waste to 500 grams. To this was added 200 grams of the de-alcoholated alkoxide mixture. The resulting mixture was heated until the temperature reached 600° C. which produced coherent solid cinders about $\frac{1}{8}$ to about $\frac{1}{4}$ inch in size.

These cinders were soaked in 15,000 grams of 25 percent ammonium hydroxide for 16 hours which resulted in the complete disintegration of the cinders. The resulting slurry was then heated at 130° F. until the ammonia was volatilized.

What we claim is:

1. A process for making a cinder aggregate from neutralized PUREX waste comprising:
   (A) concentrating said PUREX waste to about 30 to about 40 percent solids;
   (B) adding to said concentrated PUREX waste a colloid of such de-alcoholated alkoxides of silicon, boron, and aluminum as is necessary to produce a mixture containing
      (1) about 0.001 to about 1 percent aluminum hydroxide;
      (2) about 5 to about 15 percent silica; and
      (3) about 1 to about 3 percent boric oxide;
   (C) heating said mixture to about 400° to about 700° C. to produce said cinder aggregate;

(D) containing and transporting said cinder aggregate; and (E) disintegrating said cinder aggregate in ammonium hydroxide.

2. A process according to claim 1 wherein said mixture contains:

(1) about 0.001 to about 0.002 percent aluminum hydroxide;

(2) about 5 to about 10 percent silica; and (3) about 1.5 to about 2.5 percent boric acid.

3. A process according to claim 1 wherein said mixture is heated to about 550° to about 650° C.

4. A process according to claim 1 wherein the alcohol which is de-alcoholated is methanol.

5. A process according to claim 1 wherein said ammonium hydroxide is about 10 to about 29 percent.

6. A process according to claim 1 including the additional last step of heating said disintegrated cinder and ammonium hydroxide to drive off ammonia for recycling.

7. A process according to claim 1 wherein said PUREX waste is at least about 15 percent sodium.

8. Cinders comprising a product produced according to the process of claim 1.

* * * * *